United States Patent [19]

Mershon

[11] 4,300,190

[45] Nov. 10, 1981

[54] LIGHTING FIXTURE MOUNT

[75] Inventor: James M. Mershon, Crawfordsville, Ind.

[73] Assignee: National Service Industries, Atlanta, Ga.

[21] Appl. No.: 102,885

[22] Filed: Dec. 12, 1979

[51] Int. Cl.[3] ..... F21S 1/04

[52] U.S. Cl. ..... 362/404; 362/147

[58] Field of Search ..... 362/404, 147

[56] References Cited

U.S. PATENT DOCUMENTS 2,967,040 1/1961 Picha ..... 362/408

*Primary Examiner*—Stephen J. Lechert, Jr.

*Attorney, Agent, or Firm*—Richard D. Emch

[57] ABSTRACT

A mounting for a lighting fixture is disclosed which includes a T-shaped bracket and a mating plate designed to engage the T-shaped bracket in two positions. The T-shaped bracket is fixed to a desired mounting surface and the mating plate is fixed to the end of a lighting fixture intended to engage the mounting surface. The mounting plate and bracket cooperate to suspend the fixture in a first position below and spaced from the mounting surface while wiring is installed and in a second position against the mounting surface after installation is completed.

9 Claims, 11 Drawing Figures

FIG. 7
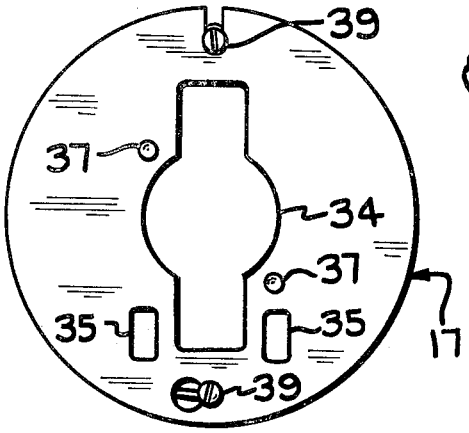
FIG. 6
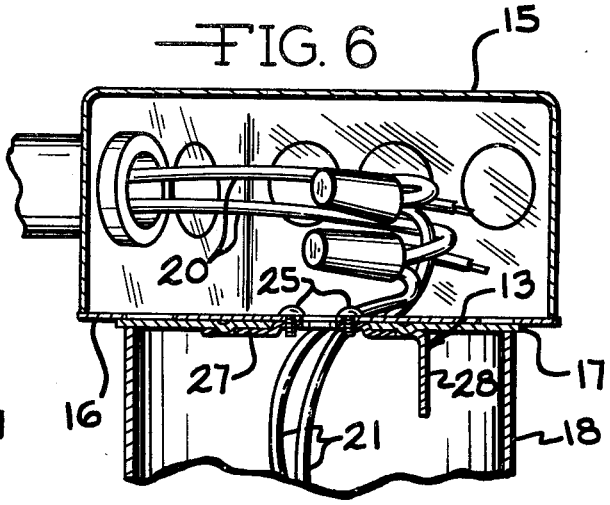
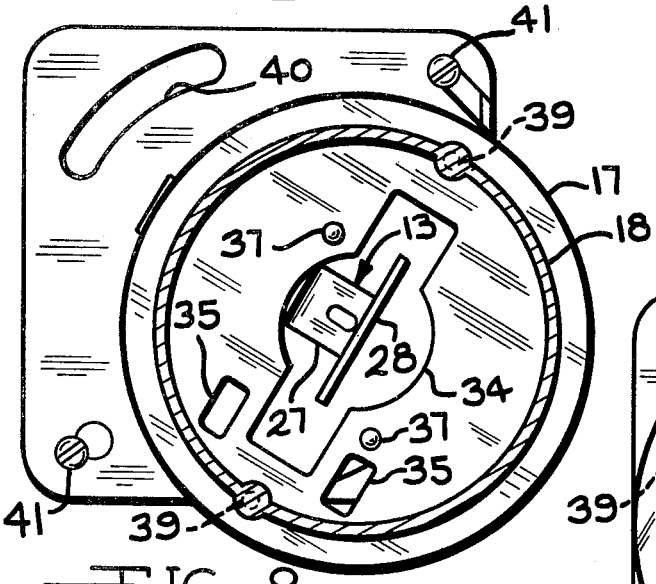
FIG. 8
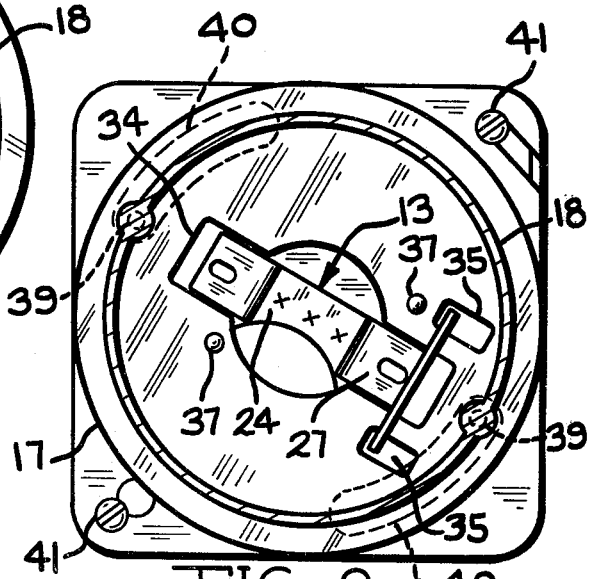
FIG. 9
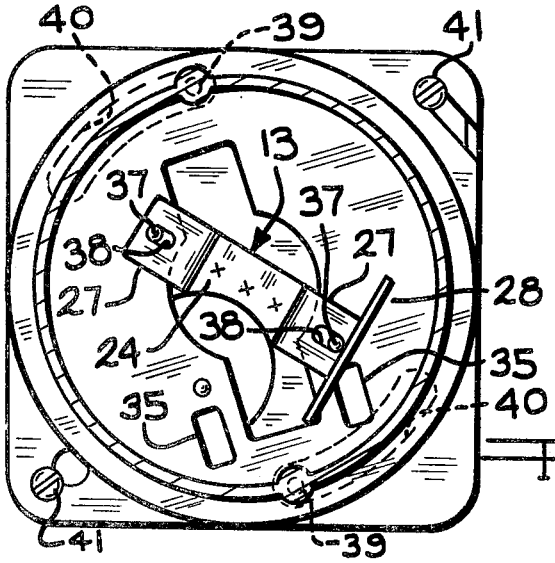
FIG. 10

LIGHTING FIXTURE MOUNT

BACKGROUND OF THE INVENTION

The present invention is generally directed to a mounting system which is used for the installation of lighting fixtures. Specifically the present invention provides a mounting bracket which permits hanging the fixture below and spaced from a mounting surface while the electrical connections are made. After installation the fixture is locked into a retrievably permanent position against the mounting surface.

One prior art mounting bracket for lighting fixtures provides hooks for hanging the lighting fixture below a mounting surface while making the electrical connections. The mounting brackets however do not prevent the fixture from being accidentally knocked or bumped from the mount while the electrical connections are being made. After the electrical connections are made the lighting fixture is moved to abut the mounting bracket and a latch on the fixture is moved to a lock position to hold the fixture against the mounting surface. This prior art fixture mounting bracket does not provide the combination of a single unit which safely hangs the light fixture during installation and then, upon rotation of the fixture, retrievably locks the fixture against the mounting surface after the electrical connections are made.

SUMMARY OF THE INVENTION

The mounting bracket of the present invention comprehends a T-shaped bracket which is attached to the intended mounting surface, and a mating plate, designed to engage the T-shaped bracket, attached to the lighting fixture. When installing the light fixture, tabs on the T-shaped bracket are placed into the corresponding openings in the mating plate so as to suspend the fixture below the mounting surface. The connection between the tabs and the mating plate prevents the lighting fixture from falling due to an accidental bump. As the fixture hangs from the T-bracket, the electrical connections can be made, without fear of the fixture dropping. When the connections are completed the fixture is closed to the mounting surface by moving the mating plate over the T-shaped bracket. Ears on the T-shaped bracket fit through corresponding slots on the mating plate. Upon rotation of the fixture, the ears override the surface of the mating plate nearest the fixture. Detents or openings in the ears engage bosses located on the mating plate to lock the fixture to the mounting surface. The lighting fixture is then firmly locked into position against the mounting surface, but may be removed simply by reversing the steps of mounting.

Accordingly it is a primary object of this invention to provide a superior mounting bracket from which a lighting fixture can be suspended below a mounting surface while the electrical connections are being made without danger of falling and which will subsequently lock the fixture against the mounting surface.

It is a further object of this invention to provide a simplified and improved bracket for attaching a lighting fixture to mounting surface.

Other objects and advantages of the invention will become apparent in the following detailed description of a preferred form, reference being had to the accompanying drawings.

BRIEF DESCRIPTION OF THE DRAWINGS

FIG. 6 is a fragmentary cross sectional view taken along line 6—6 of FIG. 5 showing the electrical connection within the junction box and the interconnection of the mating plate and the T-shaped bracket;

FIG. 7 is a detailed top view of the mating plate mounted on the lighting fixture.

FIG. 8 is a cross sectional view showing the initial interconnection between the T-shaped bracket and the mating plate;

FIG. 9 is a cross sectional view showing the positional relationship between the T-shaped bracket and the mating plate prior to rotating the lighting fixture to a locked position;

FIG. 10 is a cross sectional view along line 10—10 of FIG. 3 and showing the interconnection between the mating plate and the T-shaped bracket when the light fixture is in a final locked position with respect to the mounting surface.

DESCRIPTION OF THE PREFERRED EMBODIMENT

Figure 1:
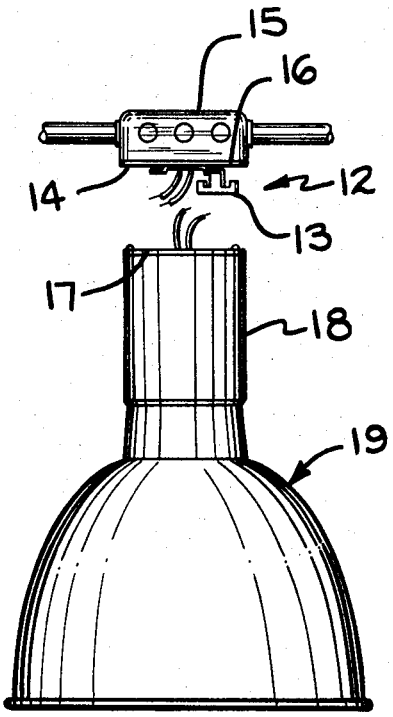
FIG. 1 is a side elevational view of the invention showing a junction box with a T-shaped bracket fixed thereto, a lighting fixture and disconnected electrical wiring.
Figure 2:
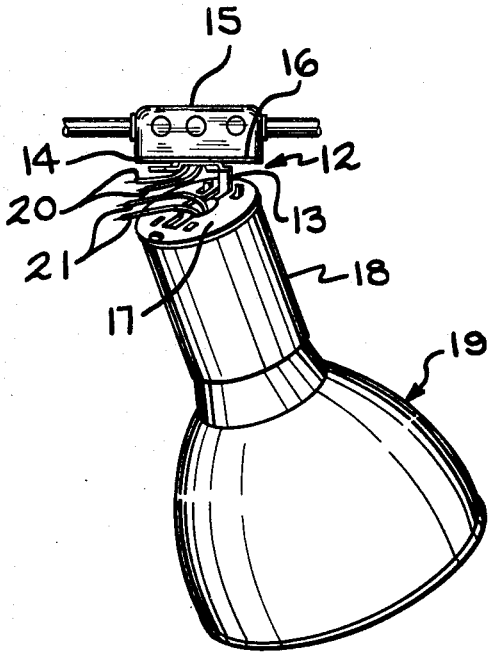
FIG. 2 is a side elevational view showing the T-shaped bracket interconnected with the mating plate with the lighting fixture hanging from the tabs on the T-shaped bracket.
Figure 3:
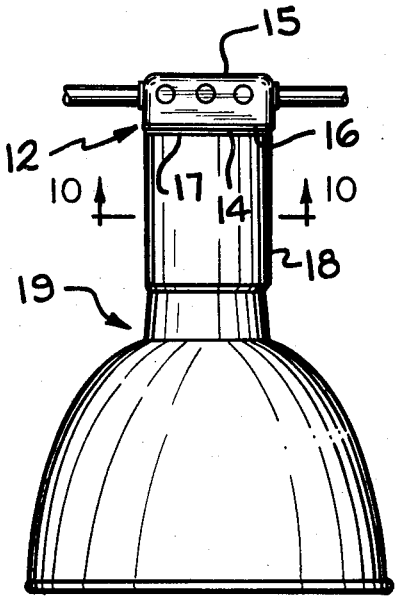
FIG. 3 is a side elevational view showing the lighting fixture in final juncture with the mounting surface of the junction box.

Referring to FIGS. 1–3, a fixture mounting 12 is illustrated according to the invention as including a T-shaped bracket 13 which is fixed to a mounting surface 14. In a preferred embodiment, the mounting surface 14 includes an electrical junction box 15 and a cover plate 16 on which the T-shaped bracket 13 is mounted. A mating plate 17, designed to correspondingly engage the T-shaped bracket 13 is fixed to the top of a ballast housing 18 on a lighting fixture 19.

During installation of the lighting fixture 19, the mating plate 17 is positioned to engage the T-shaped bracket 13 so that the lighting fixture ballast housing 18 is suspended below and spaced from the mounting surface 14. At this time, electrical wires 20 from the junction box 15 are manually connected to electrical wires 21 which extend from the lighting fixture ballast housing 18. After the electrical connections are completed, the wires and connectors are pushed into the junction box 14. The lighting fixture is then swung to a vertical position such that the mating plate 17 abuts the cover plate 16 and the lighting fixture 19 is locked in place by rotating.

Figure 5:
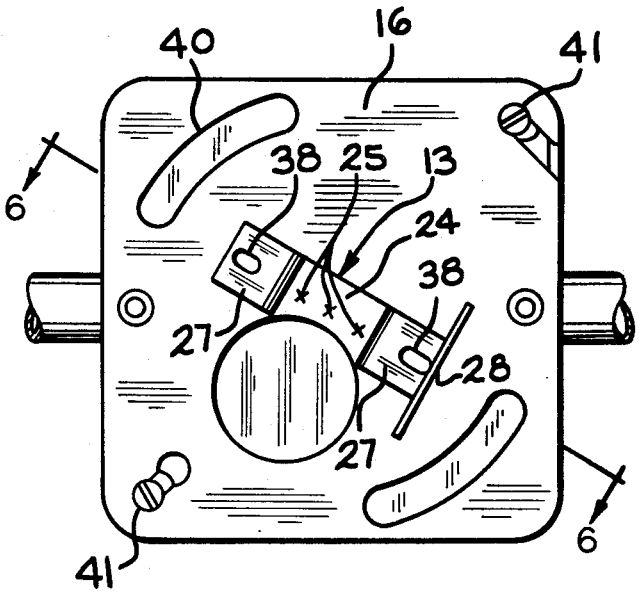
FIG. 5 is a detailed bottom view showing the cover plate for the junction box with the T-shaped bracket fixed thereto.
Figure 4:
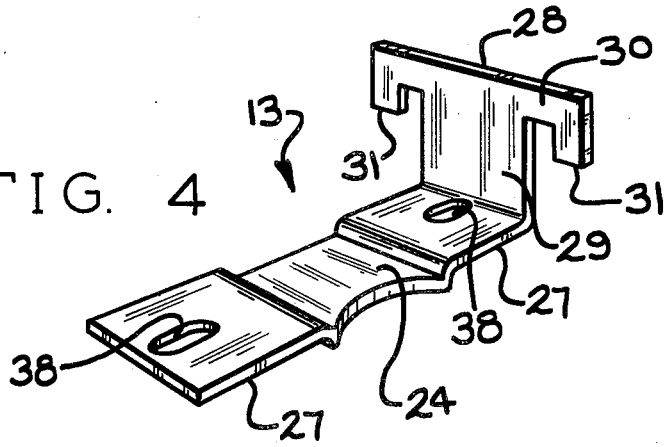
FIG. 4 is a detailed perspective view of the T-shaped bracket.

As shown in FIGS. 4, 5 and 6, the T-shaped bracket 13 includes a central flat 24 which is permanently fixed to the cover plate 16 by spot weldings 25 or with screws (not shown). Two opposed ears 27 are fixed to the central flat 24 and extend away from and parallel to the central flat 24. The opposed ears 27 are fixed to the central flat 24 so that they are spaced from the mounting surface 14 by a distance substantially equal to the thickness of the mating plate 17. A T-shaped flat 28, having a stem 29 and a cross bar 30 is connected to a free edge of one of the opposed ears 27. The T-shaped flat 28 extends outward perpendicular to the mounting surface 14. Located at the opposed ends of the cross bar 30 are tabs 31 which extend from the cross bar 30 toward the mounting surface 13. In the preferred embodiment, the T-shaped bracket 13 is stamped or otherwise formed as a single integral unit.

The mating plate 17 is designed to completely engage the T-shaped bracket 13 and to perform two functions. The mating plate 17 has a central slot 34 which is shaped to receive and permit rotation of the central flat 24 of the T-shaped bracket 11. When locking the lighting fixture 19 to the mounting surface 14, the T-shaped bracket 13 is inserted into the central slot 34, with the central flat 24 remaining in plane with the mating plate 12. Upon rotating the lighting fixture 19, the ears 27 override the mating plate 17 so that the mating plate 17 is trapped between the ears 27 on the bracket 13 and the cover plate 16.

A pair of openings 35 are located in the mating plate 17 adjacent one end of the central slot 34. The openings 35 are spaced apart to accept engagement with the tabs 31 on the T-shaped flat 28 of the bracket 13. Two bosses 37 are formed on the mating plate 17 diagonally across and adjacent the central slot 34. The bosses 37 are oppositely spaced to engage detents or holes 38 located on the ears 27 of the T-shaped bracket 13. As the lighting fixture 19 and the mating plate 17 are rotated relative to the T-shaped bracket 13 and cover plate 16, the ears 27 override the bosses 37 and the engagement of the bosses 37 and the detents 38 serves to retrievably lock the lighting fixture 19 into its desired position.

In the preferred embodiment, the mating plate 17 is fixed to the lighting fixture housing 18 by means of two screws 39. The heads of the screws 39 protrude from the surface of the mating plate 17. To effect complete engagement of the light fixture 19 with the mounting surface 14, two opposed arcuate slots 40 are located in the cover plate 16 to accept the heads of the screw 39. The engagement of the screws 39 with the ends of the slots 40 is designed to provide a mechanical stop for the rotation of the mating plate 17 relative to the T-shaped bracket 13, as shown in FIGS. 9 and 10.

Installation and use of the mounting 12 for a lighting fixture 19 is illustrated in FIGS. 8-11. The cover plate 16 having the opposed concentric arcuate slots 40 is mounted on an existing junction box 14 with two screws 41 and the T-shaped bracket 13 is mounted on the cover plate 16 by means of the spot weld 25. The mating plate 17 is mounted by means of the two screws 39 to the top of the lighting fixture housing 18.

Figure 11:
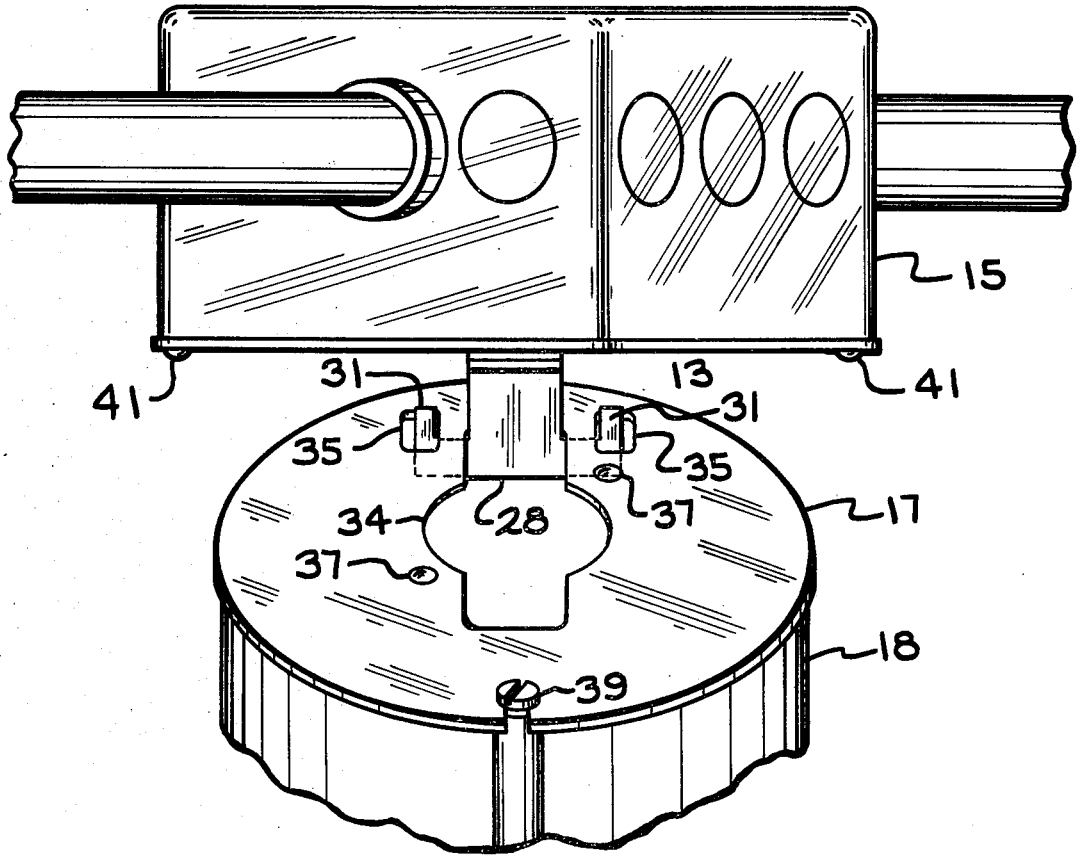
FIG. 11 is an enlarged fragmentary side elevational view showing the mating plate interconnected with the T-shaped bracket so that the lighting fixture hangs from the tabs of the T-shaped bracket.

To install the lighting fixture 19 to the mounting surface 14, the T-shaped flat 28 of the bracket 13 is inserted through the central slot 34 of the mating plate 17, as shown in FIG. 8. The lighting fixture 19 is twisted relative to the mounting surface 14 and the bracket 13 to align the tabs 31 on the T-shaped flat 28 with the pair of openings 35. To assist connection of the electrical wires 21 from the fixture 19 to the wires 20 in the junction box 14, the lighting fixture 19 is hung from the bracket 13 by engaging the tabs 31 with either of the pairs of openings 35 as shown in FIGS. 2 and 11. In this position, the lighting fixture 19 cannot be accidentally bumped or dropped while effecting connection of the electrical wires. After connection of the electrical wires, the wiring is placed into the junction box 15, as shown in FIG. 6. The lighting fixture 19 is then closed to the mounting surface 14 so that the mating plate 17 on the fixture housing 18 abuts against the cover plate 16. The heads of the screws 39 are positioned in the arcuate slots 40 found in the cover plate 16, as shown in FIG. 9. The lighting fixture 19 then is locked into a retrievably permanent position by rotating the fixture 19 so that the mating plate 17 rotates relative to the bracket 13 on the cover plate 16. The ears 27 slip over the inside surface of the mating plate 17 until the bosses 37 engage the detents or holes 38. As the lighting fixture 19 is rotated, the heads of the screws 39 move in the arcuate slots 40 to their final position abutting ends of the slots 40, as shown in FIG. 10.

As is apparent from the above description of a preferred embodiment of a fixture mount 10, the engagement or disengagement of the lighting fixture 19 to the mounting surface 14 can be easily effected. It is appreciated that other arrangements of the fixture mounting 10 may be used and that changes may be made in the elements of the mounting bracket without departing from the scope of the appended claims. For example, the bracket 13 may be attached directly to a lighting fixture and the mating plate 17 then is attached to the junction box 15.

It also should be appreciated that a second pair of openings 35 may be located adjacent the opposite end of the slot 34 so that the bracket 13 can engage either pair of openings 35 while installing electrical connections to the lighting fixture 19.

I claim:

1. A mounting for attaching a lighting fixture to a surface comprising a bracket having a T-shaped flat, a mating plate having a slot adapted to receive said bracket, means attaching said bracket to one of the lighting fixture and the surface, means attaching said mating plate to the other of the lighting fixture and the surface, means for interconnecting said T-shaped flat with said mating plate for suspending the lighting fixture below the surface, and releasable means for locking said bracket to said mating plate to suspend the lighting fixture from the surface.

2. A mounting for a lighting fixture, as defined in claim 1, wherein said bracket includes a central flat having a side for abutting the attached one of the fixture and the surface, two opposed bayonet ears fixed to said central flat and extending outward from and substantially parallel to said central flat, said two opposed ears spaced from said side by a predetermined distance at least as great as the thickness of said mating plate, and wherein said T-shaped flat has a stem and a cross bar, said stem fixed to a free edge of one of said opposed ears to extend outward in a direction generally perpendicular to the plane of said central flat.

3. A mounting for a lighting fixture, as defined in claim 2, wherein said cross bar has two opposed ends, and further including two tabs, each of said tabs fixed to a different one of said opposed cross bar ends and extending from said cross bar toward the plane of said central flat.

4. A mounting for a lighting fixture, as defined in claim 3 wherein said mating plate includes two openings spaced to receive said tabs of said T-shaped flat, said two openings and said tabs comprising said interconnecting means.

5. A mounting for a lighting fixture as defined in claim 4 wherein said releasable locking means includes at least one boss formed in one of said spaced ears and said mating plate and at least one detent formed in the other of said spaced ears and said mating plate, said boss engaging said detent when said mating plate and said bracket are rotated relative to one another to releasably lock said bracket to said mating plate.

6. A mounting for a lighting fixture, as described in claim 5 wherein said mating plate attaching means includes screws having heads which protrude from said mating plate and wherein said bracket attaching means includes a second plate having arcuate slots spaced to receive said screw heads, said arcuate slots and said screw heads cooperating to limit rotational movement between said mating plate and said second plate.

7. A mounting for a lighting fixture comprising: a bracket having a central flat attached to a mounting surface, two opposed bayonet ears fixed to said central flat and extending outward from and substantially parallel to said central flat at a predetermined distance from said mounting surface and a T-shaped flat having a stem and a cross-bar, said stem fixed to a free edge of one of said opposed ears to extend away from said mounting surface, said flat further having tabs fixed to opposed ends of said cross-bar and extending towards said mounting surface, a mating plate attached to the lighting fixture and having a central slot shaped to receive said central flat and said ears of said bracket, said mating plate further defining two openings spaced to receive said tabs of said T-shaped flat, whereby the lighting fixture is suspended below the mounting surface by engaging said T-shaped flat with said mating plate with said tabs in said two openings, and whereby the lighting fixture is mounted against the mounting surface by positioning said central flat of said bracket in said central slot in said mating plate and rotating the lighting fixture to position said mating plate between said ears and the mounting surface.

8. A mounting for a lighting fixture, as set forth in claim 7, and further including at least one boss and a mating detent means formed between said bracket and said mating plate for releasably locking the lighting fixture in its mounted position.

9. A mounting for a lighting fixture, as set forth in claim 7, and further including means for limiting rotation between the lighting fixture and the mounting surface.

* * * * *